US007805795B2

(12) United States Patent
Stein et al.

(10) Patent No.: US 7,805,795 B2
(45) Date of Patent: Oct. 5, 2010

(54) BRUSH ROLL ARRANGEMENT FOR A FLOOR CLEANING TOOL

(75) Inventors: Thomas Stein, Velbert (DE); Achim Liffers, Velbert (DE)

(73) Assignee: Stein & Co. GmbH, Velbert (DE)

( * ) Notice: Subject to any disclaimer, the term of this patent is extended or adjusted under 35 U.S.C. 154(b) by 1370 days.

(21) Appl. No.: 11/234,505

(22) Filed: Sep. 23, 2005

(65) Prior Publication Data

US 2006/0064828 A1 Mar. 30, 2006

(30) Foreign Application Priority Data

Sep. 24, 2004 (DE) ..... 10 2004 046 383

(51) Int. Cl.
*A47L 11/32* (2006.01)
*A47L 5/26* (2006.01)

(52) U.S. Cl. ..... 15/41.1; 15/392

(58) Field of Classification Search ..... 15/41.1, 15/392, 389, 390, 23, 391, 52.1; 16/18 R–18 B; 51/176

See application file for complete search history.

(56) References Cited

U.S. PATENT DOCUMENTS 22,678 A * 1/1859 Smith ..... 15/41.1
3,233,274 A 2/1966 Kroll
3,284,830 A * 11/1966 Kroll ..... 15/52.1
4,437,199 A 3/1984 Wulf et al.
4,456,136 A * 6/1984 Palsson ..... 215/216
5,231,725 A * 8/1993 Hennessey et al. ..... 15/83
5,272,785 A * 12/1993 Stegens ..... 15/179
5,509,162 A * 4/1996 Burgoon ..... 15/52.1

FOREIGN PATENT DOCUMENTS

EP 0 062 743 10/1982

* cited by examiner

*Primary Examiner*—Joseph J Hail, III
*Assistant Examiner*—Jamal Daniel
(74) *Attorney, Agent, or Firm*—W. F. Fasse; W. G. Fasse

(57) ABSTRACT

A brush roll is rotatably supported by bearings in a housing of a cleaning brush tool. One of the bearings is incorporated in a removable bearing arrangement that can be rotationally fastened and removed as needed on a cylindrical end of the housing. Preferably collar elements protruding cylindrically from the removable bearing arrangement form bayonet-type catch hooks that selectively engage with bayonet-type catch elements protruding radially outwardly from the cylindrical end sleeve of the housing. A detent on the housing engages a securing element on the removable bearing arrangement to secure the engaged bayonet-type fastening arrangement against rotational release thereof.

18 Claims, 2 Drawing Sheets

BRUSH ROLL ARRANGEMENT FOR A FLOOR CLEANING TOOL

PRIORITY CLAIM

This application is based on and claims the priority under 35 U.S.C. §119 of German Patent Application 10 2004 046 383.2, filed on Sep. 24, 2004, the entire disclosure of which is incorporated herein by reference.

FIELD OF THE INVENTION

The invention relates to a brush roll arrangement for a cleaning tool, such as a floor cleaning tool, a carpet cleaning tool, an upholstery brush tool or a brush tool head of a vacuum cleaner, having at least one rotating brush roll supported by bearings.

BACKGROUND INFORMATION

Brush roll arrangements of the above mentioned general type are known in various different configurations and embodiments, particularly in relation to brush tools for vacuum cleaners. In such a brush roll arrangement, it is conventionally known that at least one of the bearings supporting the brush roll may be a removable bearing, i.e. so that this bearing can be removed to allow removal of the brush for cleaning and maintenance purposes. Various different arrangements of such a removable bearing are known in the art. However, it has been found in practice, that it is difficult for the user of the tool to easily remove the removable bearing without the need of tools, and particularly through simple manipulations by hand. It has further been difficult to simultaneously achieve the required secure fixing of the removable bearing in its installed condition to ensure a sufficient operating safety. In other words, the prior art arrangements have been unable to simultaneously satisfy these opposite demands, namely easy removability of the bearing by hand, and also secure fixing of the bearing in its installed condition.

SUMMARY OF THE INVENTION

In view of the above, it is an object of the invention to provide a brush roll arrangement that includes a particularly simple construction of a removable bearing that can be easily removed by hand, and can again easily be re-installed by hand to achieve a securely fixed installed condition. A further object of the invention is to provide a removable bearing arrangement in which a rotating motion allows the bearing to be released or secured as desired, and the released bearing can be axially removed from an end of the brush roll arrangement, to allow the removal of the brush roll. The invention further aims to avoid or overcome the disadvantages of the prior art, and to achieve additional advantages, as apparent from the present specification. The attainment of these objects is, however, not a required limitation of the claimed invention.

The above objects have been achieved according to the invention in a cleaning brush tool, for example a brush tool, floor cleaning tool, carpet tool, brush head, or the like of a vacuum cleaner. The cleaning brush tool includes at least one brush roll that is rotatably supported for rotation about a longitudinal axis at two opposite ends of the brush roll by two rotation bearings in a brush housing. The brush roll may be rotationally driven by an electric motor, air turbine, or the like, for example via a drive belt. One of the bearings is carried by a bearing mount, which together form a removable bearing arrangement that is selectively secured to or removable from the brush housing, to allow the brush roll to be removed from the brush housing. Particularly, the removable bearing arrangement is removably arranged on a cylindrical end sleeve of the brush housing and is securable by a rotational fastening arrangement involving the rotational cooperation of respective components of the brush housing and the removable bearing arrangement. An additional latching arrangement latches or fixes the removable bearing arrangement against rotation in the removal direction. All of the elements necessary for these fastening and latching functions are integrated in the removable bearing arrangement and the cylindrical end sleeve of the brush housing, so that no separate parts are needed in this regard.

More particularly, the above objects have been achieved according to the invention in a cleaning brush tool in which the bearing mount of the removable bearing arrangement includes one or more collar elements that can be set onto or into the cylindrical end sleeve of the brush housing, such that the removable bearing arrangement is axially slidable while also being pivotable or partially rotatable relative to the cylindrical end sleeve of the brush housing. At least two catch elements are provided on the cylindrical end sleeve of the brush housing and respectively cooperate with catch grooves forming catch hooks in the collar elements of the removable bearing arrangement. Namely, the catch elements can be engaged into the catch grooves of the catch hooks by suitable alignment and rotation of the removable bearing arrangement, to achieve a bayonet-type engagement of the removable bearing arrangement on the cylindrical end sleeve of the brush housing. Furthermore, in this engaged position, a latch or securing element on the removable bearing arrangement engages a latch dog or detent provided on the brush housing, so as to latch and secure the removable bearing arrangement and prevent the unintended releasing rotation thereof.

According to further preferred details of an embodiment of the invention, a guide structure provided on each collar element of the removable bearing arrangement leads into the catch groove of the catch hook. This guide structure is preferably a helically sloping guide surface, and the catch element has a corresponding sloping wall that cooperates with the sloping guide surface to guide the catch element into the catch groove.

In a further preferred embodiment, the securing arrangement includes a latch detent that is tiltable, pivotable, or flexibly deflectable on the brush housing, so as to selectively engage with or disengage from the latch or securing element of the removable bearing arrangement. For example, a press button connected to or acting on the latch detent allows it to be deflected out of engagement with the latch or securing element, for releasing the removable bearing arrangement.

The rotational fastening arrangement and particularly the bayonet-type fastening arrangement is advantageously configured and constructed in such a manner so that the removable bearing arrangement is released and can then be axially removed from the cylindrical end sleeve of the housing at least through a rotational motion of ninety degrees. Namely, rotating the removable bearing arrangement by not more than ninety degrees will rotationally disengage it from the cylindrical end sleeve of the housing, whereupon it can be axially removed to allow further removal of the brush roll.

BRIEF DESCRIPTION OF THE DRAWINGS

In order that the invention may be clearly understood, it will now be described in connection with example embodiments thereof, with reference to the accompanying drawings, wherein.

Figure 1A:
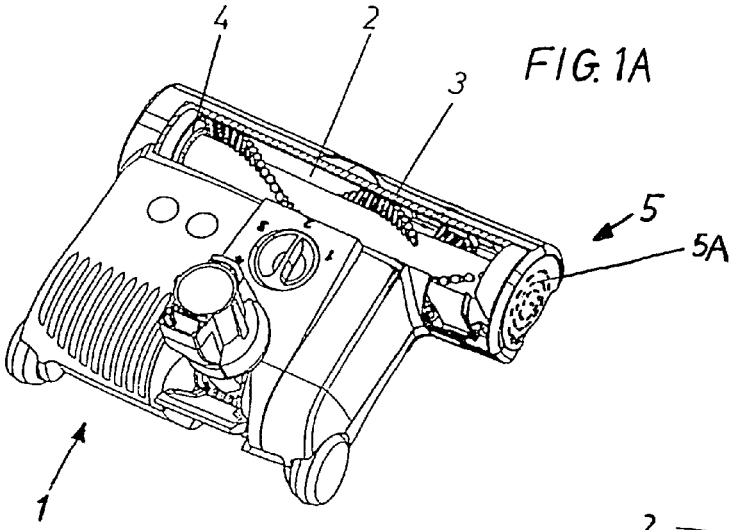
FIG. 1A is a perspective general overview of a vacuum brush tool according to the invention, having a partially sectioned-open housing to show features of an embodiment of an inventive brush roll arrangement.
Figure 1C:
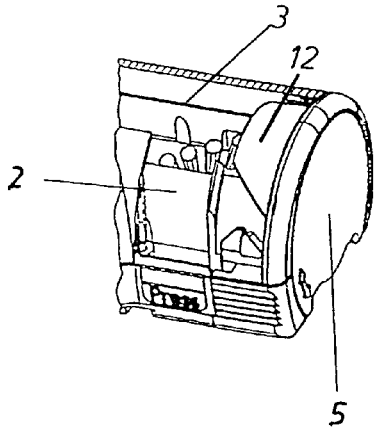
FIG. 1C is a view similar to FIG. 1B, but showing the removable bearing arrangement in an engaged and secured or latched condition.
Figure 1B:
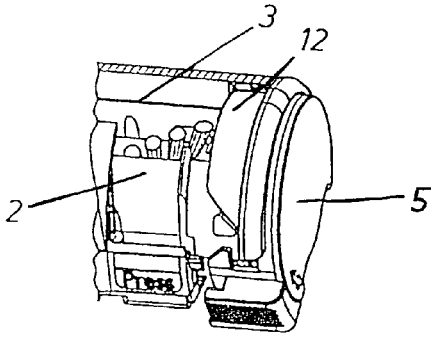
FIG. 1B is an enlarged view of a portion of FIG. 1A, showing the removable bearing arrangement in a disengaged or released condition.

DETAILED DESCRIPTION OF PREFERRED EXAMPLE EMBODIMENTS AND OF THE BEST MODE OF THE INVENTION

In the illustrated example, the vacuum cleaner brush head, floor cleaning tool, or brush tool 1 includes a rotatable brush roll 2 arranged in a brush housing 3. The brush roll 2 is rotatably supported for rotation about the longitudinal axis A, at two opposite ends of the brush roll 2 by respective rotation bearings 4 and 5A. While the bearing 4 may be a conventional fixed bearing that is fixedly secured in the brush housing 2, the bearing 5A is incorporated in a removable bearing arrangement 5 according to the invention. This removable bearing arrangement 5 is selectively secured to the brush housing 3 to rotatably support the brush roll 2, or is selectively removable to allow the brush roll 2 to be removed from the housing 3 (for example for cleaning, maintenance, or replacement of the brush roll 2). The removable bearing arrangement 5 and the brush roll 2 can be removed from the housing 3 in the axial direction, i.e. parallel to the longitudinal axis A of the brush roll 2 and the housing 3.

The removable bearing arrangement 5 includes the bearing 5A, which may be any conventionally known or future developed type of rotation bearing, for example a ball bearing, a roller bearing, a sleeve bearing, or the like. The removable bearing arrangement 5 further includes a bearing mount that carries the bearing 5A and that may be configured as a bearing mount cup including an end cap and one or more cylindrical collar elements. The bearing mount preferably includes two collar elements 12 that are each a partial cylindrical shell or collar portion protruding from the end cap toward the brush housing 3 partially cylindrically around the axis A. The removable bearing arrangement 5 further includes a latch or securing element 10.

The collar elements 12 of the removable bearing arrangement 5 can be axially pushed onto or into the cylindrical end of the brush housing 3. Particularly, in the example embodiment of FIGS. 2 and 3, the end of the housing 3 includes a cylindrical end sleeve 3A that fits into the collar elements 12, i.e. the collar elements 12 can be pushed coaxially onto the cylindrical end sleeve 3A. The removable bearing arrangement 5 is also at least partially rotatable about the axis A on the cylindrical end sleeve 3A of the housing 3. Such rotation can selectively secure or release the removable bearing arrangement 5 relative to the cylindrical end sleeve 3A as follows.

Figure 2:
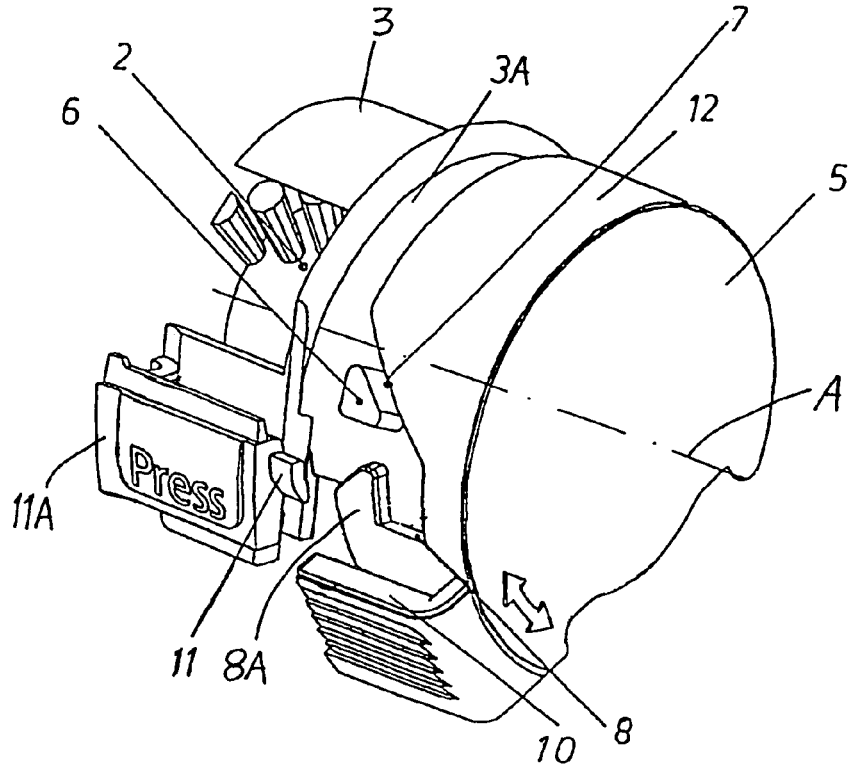
FIG. 2 is a further enlarged detail view of the disengaged or released condition of an embodiment of the removable bearing arrangement.
Figure 3:
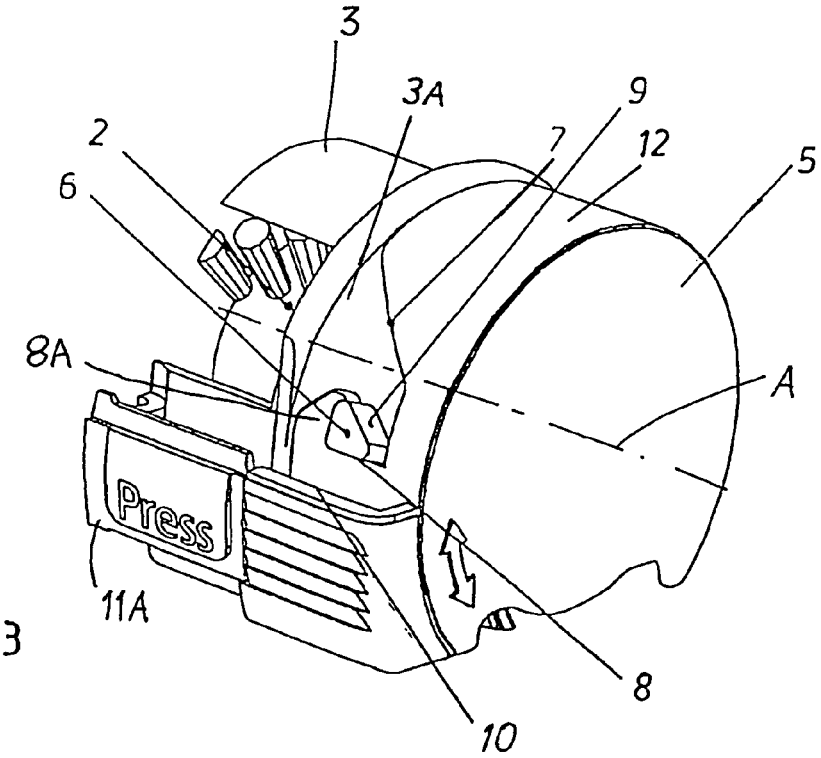
FIG. 3 is an enlarged detail view like FIG. 2, but showing the removable bearing arrangement in the engaged and secured or latched condition.

Two catch elements 6 protruding radially outwardly are provided at diametrically opposed positions on the cylindrical end sleeve 3A of the housing 3. On the other hand, the collar elements 12 of the removable bearing arrangement 5 are configured with a sloping guide surface 7 along an edge of each collar element 12, extending along a helical spiral line about the axis A, and leading into a catch groove 8 formed behind a catch hook 8A of the adjacent collar element 12. While only one catch element 6 and one catch hook 8A with a catch groove 8 and a guide surface 7 are shown in FIGS. 2 and 3, similar structures are arranged rotationally symmetrically at a diametrically opposite position. Instead of two sets of such, structures, it is alternatively possible to provide three or even more sets of such structures distributed uniformly around the circumference of the removable bearing arrangement 5. These structures 6, 8 and 8A form a bayonet-type fastening arrangement.

To engage the removable bearing structure 5 onto the end of the housing 3, the bearing arrangement 5 is moved axially onto the cylindrical end sleeve 3A so that the sloping guide surface 7 corresponds in position and then physically contacts and cooperates with the respective catch element 6 of the cylindrical end sleeve 3A. The catch element 6 preferably has a sloping wall 9 that cooperates with the sloping guide surface 7. This position is shown in FIG. 2, whereby the bearing arrangement 5 is in a disengaged or released condition.

By then rotating the bearing arrangement 5 in a clockwise direction, to reach the position shown in FIG. 3, the sloping guide surface 7 slides along the catch element 6, until the catch element 6 is received in the catch groove 8 behind the catch hook 8A of the adjacent collar element 12. Due to the engagement of the catch hook 8A axially behind the catch element 6, it is no longer possible to remove the bearing arrangement 5 axially from the cylindrical end sleeve 3A of the housing 3 in the engaged condition shown in FIG. 3.

Furthermore, the engaged condition of FIG. 3 is latched or secured with a latch or securing element 10 to prevent an unintended rotational disengagement thereof. The securing element 10 may simply involve an undercut edge, a protruding lip, a catch rim, or one or more ratchet grooves configured and arranged on a suitable part of the removable bearing arrangement 5 to cooperate with the latch dog or detent 11 of the brush housing 3. In this regard, in FIG. 3, the securing element 10 has been engaged with, e.g. engaged rotationally behind, the latch detent 11. This latch detent 11 is pivotally, flexibly, deflectably, or otherwise movably connected to the housing 3. For example, it is connected to or acted on by a press button 11A, which may be depressed by a user of the tool 1 to disengage the latch detent 11 from the securing element 10 so as to allow the rotational disengagement of the removable bearing arrangement 5 from the engaged condition shown in FIG. 3 to the disengaged condition shown in FIG. 2. When rotationally disengaging the bearing arrangement 5, the sloping guide surface 7 rides along the catch element 6, and thereby tends to push the bearing arrangement 5 axially away from the housing 3. This contributes to the next step, which involves axially pulling the bearing arrangement 5 off of and away from the cylindrical end sleeve 3A. Then the brush roll 2 can simply be pulled axially out of the brush housing 3 to carry out its cleaning, maintenance, or replacement. In this regard, the ends of the brush roll shaft may simply be pushed axially into the internal bearing races of the bearings 4 and 5A.

A circular or cylindrical shape of the sleeve 3A does not require a complete continuous cylinder, but can involve partial cylindrical collars for example. The bearing 4 need not be fixed, but can also be removable.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A cleaning brush tool comprising:

a brush housing having an axially open end portion defining an opening at an axial end of said brush housing in an axial direction;

a brush roll arranged in said brush housing such that said brush roll is rotatable about a rotation axis and extends longitudinally along said rotation axis in said axial direction;

a first bearing that rotatably supports a first end of said brush roll relative to said brush housing so that said first end of said brush roll is rotatable about said rotation axis; and a removable bearing arrangement that includes a second bearing and a bearing mount which carries said second bearing;

wherein:

said second bearing rotatably supports a second end of said brush roll to be rotatable about said rotation axis;

said bearing mount is removably connected to said axially open end portion of said brush housing proximate to said second end of said brush roll such that said bearing mount covers said opening defined by paid axially open end portion of said brush housing;

said bearing mount includes a first rotational fastening structure configured along a cylinder about said rotation axis, and a first securing element;

said end portion of said brush housing includes a second rotational fastening structure configured along said cylinder about said rotation axis, and a second securing element;

said bearing mount and said end portion of said brush housing are so configured and cooperate with one another so that said bearing mount can be selectively connected to said end portion of said brush housing so as to cover said opening and can be selectively removed from said end portion of said brush housing so as to uncover said opening, by said bearing mount being rotated about said rotation axis and moved relative to said housing in said axial direction along said rotation axis;

said bearing mount and said end portion of said brush housing are so configured and cooperate with one another so that when said bearing mount is arranged in or on said end portion of said brush housing so as to cover said opening, said first and second rotational fastening structures selectively cooperate and engage with one another to fasten said removable bearing arrangement to said end portion of said brush housing by rotation of said bearing mount about said rotation axis relative to said housing; and said bearing mount and said end portion of said brush housing are so configured and cooperate with one another so that when said removable bearing arrangement is fastened to said end portion of said brush housing by engagement of said first and second rotational fastening structures with one another, said first and second securing elements engage with one another to secure said bearing mount against rotation about said rotation axis relative to said brush housing in a rotation direction that would disengage said first and second rotational fastening structures from one another.

2. The cleaning brush tool according to claim 1, wherein said first and second rotational fastening structures comprise a bayonet coupling including a bayonet catch and a bayonet hook that is configured and arranged to selectively hook onto said bayonet catch by rotation of said bearing mount about said rotation axis.

3. The cleaning brush tool according to claim 2, wherein said first rotational fastening structure comprises said bayonet hook on said bearing mount, and said second rotational fastening structure comprises said bayonet catch on said end portion of said brush housing.

4. The cleaning brush tool according to claim 1, wherein said end portion of said brush housing protrudes at least partially cylindrically along said cylinder, said bearing mount comprises a bearing mount cup including an end cap and collar elements protruding at least partially cylindrically along said cylinder from said end cap, and said collar elements fit coaxially about said rotation axis outside onto said end portion of said brush housing.

5. The cleaning brush according to claim 1, wherein said brush roll is arranged in said brush housing, and said brush housing and said removable bearing arrangement are configured and cooperate so that said brush roll can be removed out of said brush housing axially through said opening without use of any tool by manually pulling said brush roll along said rotation axis through said opening and out of said end portion of said brush housing after manually completely separating and removing said removable bearing arrangement from said brush housing.

6. A cleaning brush tool comprising:

a brush housing having an axially open end portion defining an opening at an axial end of said brush housing in an axial direction;

a brush roll arranged in said brush housing such that said brush roll is rotatable about a rotation axis and extends longitudinally along said rotation axis in said axial direction;

a first bearing that rotatably supports a first end of said brush roll relative to said brush housing so that said first end of said brush roll is rotatable about said rotation axis; and a removable bearing arrangement that includes a second bearing and a bearing mount which carries said second bearing;

wherein:

said second bearing rotatably supports a second end of said brush roll to be rotatable about said rotation axis;

said bearing mount is removably connected to said axially open end portion of said brush housing proximate to said second end of said brush roll such that said bearing mount covers said opening defined by said axially open end portion of said brush housing;

said bearing mount and said end portion of said brush housing are so configured and cooperate with one another so that said bearing mount can be selectively connected to said end portion of said brush housing so as to cover said opening and can be selectively removed from said end portion of said brush housing so as to uncover said opening, by said bearing mount being rotated about said rotation axis and moved relative to said housing in said axial direction along said rotation axis;

said bearing mount includes at least one collar element that extends along a cylinder about said rotation axis and that fits onto or into said end portion of said brush housing;

said at least one collar element or said end portion has at least two bayonet coupling catch grooves therein;

said end portion or said at least one collar element has thereon at least two bayonet coupling catch elements that are configured and positioned to be selectively engageable into said catch grooves by relative rotation between said bearing mount and said end portion of said brush housing about said rotation axis; and said bearing mount and said brush housing further have respective latch elements that are configured and positioned to selectively engage one another and prevent rotation of said bearing mount relative to said brush housing about said rotation axis in at least a rotation direction that would disengage said catch elements from said catch grooves.

7. The cleaning brush tool according to claim 6, wherein said at least one collar element fits externally onto said end portion of said brush housing.

8. The cleaning brush tool according to claim 6, wherein said catch elements are provided on said end portion of said brush housing and said catch grooves are provided on said at least one collar element of said removable bearing arrangement.

9. The cleaning brush tool according to claim 6, wherein said at least one collar element or said end portion further has at least two helically sloping guide surfaces that slope helically about said rotation axis respectively into said catch grooves, and said catch elements respectively have helically sloping guide walls that slope helically about said rotation axis and that are arranged and configured to face, contact and slide along said sloping guide surfaces during rotation of said bearing mount relative to said end portion of said brush housing about said rotation axis to engage said catch elements in said catch grooves.

10. The cleaning brush tool according to claim 6, wherein said latch elements include a securing element provided on said bearing mount and a deflectable detent that is provided on said brush housing so as to selectively engage said securing element when said bearing mount is rotated relative to said end portion of said brush housing about said rotation axis.

11. The cleaning brush tool according to claim 10, wherein said securing element comprises an undercut or protruding rim or a ratchet groove, and said deflectable detent comprises a pawl that selectively engages under, behind or into said rim or ratchet groove.

12. The cleaning brush tool according to claim 10, wherein said deflectable detent is pivotably connected to said brush housing so as to be manually pivotally deflectable out of engagement with said securing element.

13. The cleaning brush tool according to claim 10, wherein said deflectable detent is flexible so as to be manually flexibly deflectable out of engagement with said securing element.

14. The cleaning brush tool according to claim 10, wherein said deflectable detent includes a manual press button that can be manually pressed to deflect said detent out of engagement with said securing element.

15. The cleaning brush tool according to claim 6, wherein said removable bearing arrangement can be selectively mounted on and completely removed from said end portion of said brush housing in a direction along said rotation axis entirely manually without use of any tool.

16. The cleaning brush tool according to claim 15, wherein said brush roll can be removed out of said brush housing axially through said opening without use of any tool by manually pulling said brush roll in said axial direction along said rotation axis through said opening and out of said end portion of said brush housing after manually removing said removable bearing arrangement.

17. A cleaning brush tool comprising:

a brush housing having an axially open cylindrical end portion defining an opening at an axial end of said brush housing in an axial direction;

a brush roll arranged in said brush housing such that said brush roll is rotatable about a rotation axis and extends longitudinally along said rotation axis in said axial direction;

a first bearing that rotatably supports a first end of said brush roll relative to said brush housing so that said first end of said brush roll is rotatable about said rotation axis; and a removable bearing arrangement that includes a second bearing and a bearing mount which carries said second bearing;

wherein:

said second bearing rotatably supports a second end of said brush roll to be rotatable about said rotation axis;

said bearing mount is configured to be mounted in said axial direction along said rotation axis into or onto said cylindrical end portion of said brush housing proximate to said second end of said brush roll, such that said bearing mount covers said opening defined by said end portion of said brush housing;

said bearing mount and said cylindrical end portion are configured and cooperate with one another so that said bearing mount is removably fastened in or on said cylindrical end portion by rotation of said bearing mount relative to said cylindrical end portion about said rotation axis; and said bearing mount is externally manually removable from said cylindrical end portion in said axial direction so as to uncover said opening, and then said brush roll is manually removable out of said brush housing in said axial direction through said opening.

18. The cleaning brush tool according to claim 17, wherein said bearing mount is releasable from said cylindrical end portion by rotation of said bearing mount about said rotation axis by 90° relative to said cylindrical end portion.

* * * * *

UNITED STATES PATENT AND TRADEMARK OFFICE

CERTIFICATE OF CORRECTION

PATENT NO. : 7,805,795 B2
APPLICATION NO. : 11/234505
DATED : October 5, 2010
INVENTOR(S) : Thomas Stein et al.

It is certified that error appears in the above-identified patent and that said Letters Patent is hereby corrected as shown below:

Column 2,
Line 23, after "housing", insert --,--;

Column 4,
Line 9, after "such", delete ",";

Column 5,
Line 26, after "by", replace "paid" by --said--.

Signed and Sealed this
Twenty-fifth Day of September, 2012

David J. Kappos

David J. Kappos
*Director of the United States Patent and Trademark Office*